US005357268A

United States Patent [19]

Kishida et al.

[11] Patent Number: 5,357,268

[45] Date of Patent: Oct. 18, 1994

[54] INK JET RECORDING HEAD IN WHICH THE EJECTION ELEMENTS ARE DRIVEN IN BLOCKS

[75] Inventors: Hideaki Kishida, Yamato; Akira Katayama, Yokohama; Kimiyuki Hayasaki, Yokohama; Nobuyuki Watanabe, Yokohama; Jiro Moriyama, Yokohama; Toshiaki Hirosawa, Hiratsuka; Torachika Osada, Kawasaki; Hidemi Kubota, Tokyo; Yutaka Koizumi, Tokyo; Mineo Kaneko, Tokyo, all of Japan

[73] Assignee: Canon Kabushiki Kaisha, Tokyo, Japan

[21] Appl. No.: 933,928

[22] Filed: Aug. 24, 1992

Related U.S. Application Data

[62] Division of Ser. No. 649,725, Feb. 1, 1991, Pat. No. 5,173,717.

[30] Foreign Application Priority Data

| | | | |
|---|---|---|---|
| Feb. 2, 1990 | [JP] | Japan | 2-22173 |
| Feb. 2, 1990 | [JP] | Japan | 2-22184 |
| Feb. 2, 1990 | [JP] | Japan | 2-22193 |
| Feb. 26, 1990 | [JP] | Japan | 2-45315 |

[51] Int. Cl.[5] ..... B41J 2/05

[52] U.S. Cl. ..... 347/13

[58] Field of Search ..... 346/1.1, 140

[56] References Cited

U.S. PATENT DOCUMENTS

| | | | |
|---|---|---|---|
| 4,216,481 | 8/1980 | Hakoyama . | |
| 4,251,823 | 2/1981 | Sagae . | |
| 4,293,865 | 10/1981 | Jinnai et al. . | |
| 4,300,144 | 11/1981 | Isayama et al. . | |
| 4,313,124 | 1/1982 | Hara . | |
| 4,345,262 | 8/1982 | Shirato et al. . | |
| 4,366,489 | 12/1982 | Yamaguchi . | |
| 4,454,516 | 6/1984 | Moriguchi et al. . | |
| 4,459,600 | 7/1984 | Sato et al. . | |
| 4,463,359 | 7/1984 | Ayata et al. . | |
| 4,520,373 | 5/1985 | Ayata | 346/140 |
| 4,558,333 | 12/1985 | Sugitani et al. . | |
| 4,578,687 | 3/1986 | Cloutier et al. . | |
| 4,596,995 | 6/1986 | Yamakawa | 346/160 |
| 4,723,129 | 2/1988 | Endo et al. . | |
| 4,740,796 | 4/1988 | Endo et al. . | |
| 4,873,535 | 10/1989 | Sasaki . | |
| 4,876,559 | 10/1989 | Nishikawa . | |
| 5,172,130 | 12/1992 | Takahashi | 346/1.1 |

FOREIGN PATENT DOCUMENTS

| | | |
|---|---|---|
| 0103943 | 3/1984 | European Pat. Off. . |
| 0318328 | 5/1989 | European Pat. Off. . |
| 59-123670 | 7/1984 | Japan . |
| 59-138461 | 8/1984 | Japan . |
| 1586590 | 3/1981 | United Kingdom . |
| 2087116 | 5/1982 | United Kingdom . |

*Primary Examiner*—Joseph W. Hartary

*Attorney, Agent, or Firm*—Fitzpatrick, Cella, Harper & Scinto

[57] ABSTRACT

An ink jet recorder includes a plurality of recording elements which are arranged corresponding to each of a plurality of ejection outlets for ejecting ink in accordance with driving signals, a plurality of ejection passages corresponding to the ejection outlets and connected to a common chamber, a plurality of driving blocks formed by dividing the recording elements by predetermined number of units in the arrangement order, control elements for each of the driving blocks and for controlling the recording elements associated with each driving block in a simultaneous driving manner, a selection unit for selecting the driving block to be driven in order that at least adjacent driving blocks are not driven in sequence, and a supply unit for supplying driving signals to the driving block selected by the said selecting unit. With this arrangement, ink in ejection passages associated with a driving block adjacent the selected driving block will not be significantly affected when the selected driving block is driven.

17 Claims, 16 Drawing Sheets

INK JET RECORDING HEAD IN WHICH THE EJECTION ELEMENTS ARE DRIVEN IN BLOCKS

This application is a division of application Ser. No. 07/649,725 filed Feb. 1, 1991, U.S. Pat. No. 5,173,717.

BACKGROUND OF THE INVENTION

1. Field of the Invention

The present invention relates to an ink jet recording head and an ink jet recorder incorporating the recording head, and more particularly is directed to a block-driving technique for a full-multiple type ink jet recording head.

2. Related Background Art

An ink jet recorder forms ejection ink droplets in compliance with a variety of methods and adheres these onto materials to be recorded thereon such as record paper to produce characters thereon. Above all, the ink jet recorder which utilizes heat as an energy source for forming ejection ink droplets is adapted to include multiple nozzles of high density with ease so as to have an improved characteristic that images with high resolution and quality can be obtained with higher speed.

This type of ink jet recorder comprises a plurality of ink droplets forming means for ejecting ink droplets through an ejection outlet by applying heat energy to ink, that is to say, a plurality of ink droplets forming means having an electric/thermal transducer which generates heat through the supply of electrical current pulse to heat ink, a plurality of integrated circuits (driving IC) arranged in the same substrate and for driving the electric/thermal transducer, and a recording head for a line printer, in other words, a so-called full multiple type recording head in which the outlets are disposed across the entire width of the member to be recorded thereon. This full-multiple type recording head employs a so-called block driving method in which a plurality of blocks each including a predetermined number of electric/thermal transducers are formed to drive by time division, in order to reduce the amount of electric current flowing at the time of driving.

Incidentally, the ink jet recorder making use of heat energy produces bubbles in the ink through the activation of electric/thermal transducer and ejects the ink directly from the ink ejection outlet of the recording head by virtue of the pressure resulting from the bubbles to thereby carry out recording. Therefore, it is necessary to keep the ink constantly stable and ready to be ejected.

The fluctuation (so-called back wave) in the pressure caused by ejecting the ink through the activation of the electric/thermal transducers, now and then vibrates ink in the adjacent ink passages through a common ink chamber. When the electric/thermal transducers arranged in the adjacent ink passages are successively driven, the ejection becomes unstable due to the fluctuation in the pressure arising from the previously driven electric/thermal transducer, thus bringing about the change in the amount of ejection ink to thereby cause irregularity in depth of the recorded image. In addition, the more the number of bits (the number of electric/-thermal transducers included in one block) which are simultaneously driven, or the shorter the distance from the ejection outlet to be driven, the more this fluctuation in the amount of the ejection ink based on the fluctuation in the ink pressure occurs. It is also greatly influenced by the configuration of the common ink chamber which communicates with the ejection outlet.

In order to solve these problems, all the electricity may be driven at the same time. However, the electric current flowing into one electric/thermal transducer is large as much as several 10 mA to several 100 mA, so that an enormous amount of the electric current is required during driving and it is unsuitable for miniaturizing the driving source and the recording heads. For this reason, as described above, there has been used the method in which a plurality of blocks each including a plurality of electric/thermal transducers are formed to drive by time division. Furthermore, in U.S. Pat. No. 4,578,678, there is provided an atmospheric exposure section for ink in a part of the recording head, to thereby diffuse fluctuation in the pressure inside the common ink chamber at the time of ejecting ink through the specified ejection outlet, thus preventing it from interfering with the other ink passages. This method has, however, disadvantages that a minute air dust is liable to enter through the atmospheric exposure section, defectiveness of the ink ejection is induced by changes in physical properties attributable to the vaporization of ink, and the fixing of ink impedes the ink ejection. In order to overcome these disadvantages, the apparatus becomes more complicated.

One of measures for minimizing the occurrence of the problems due to the interference is that the distance d from the rear section of the energy generating member to the rear section of the common ink chamber is maintained sufficiently long. On experiment, the distance d was set longer than 6.0 (mm) to minimize the interference. This method goes, however, against the demand of minimizing dimensions of the recording head and the recorder itself. Additionally, as Si substrates are expensive parts, enlargement of the recording head leads to the increase of the manufacturing cost. In order to prevent the interference, the timing for ink ejection through the ejection outlet of a block after ejecting ink through the ejection outlet of the adjacent block is set after the elapse of time enough for the meniscus to return to the normal condition without being convex or concave. However, this method goes against the demand of high speed recording. The lag in the ejection timing brings about steps in the recorded characters or images and deteriorates the quality level of recording.

SUMMARY OF THE INVENTION

It is an objective of the present invention to provide an ink jet recording head and an ink jet recorder in which the influence of the fluctuation in the ink pressure upon the recorded images can be eliminated.

It is another objective of the present invention to provide an ink jet recording head and an ink jet recorder which is capable of recording with high quality level and high speed as being well as small-sized.

It is a further objective of the present invention to provide an ink jet recording head and an ink jet recorder suitable for the block driving in which the recorded images can be prevented from deteriorating due to the fluctuation in the pressure of ink.

In order to achieve the above objects, the ink jet recorder according to the present invention comprises:

a plurality of recording elements which are arranged corresponding to each of a plurality of ejection outlets and for ejecting ink in accordance with driving signals;

a plurality of drive blocks which are formed by dividing the recording elements by a predetermined number of units in the arrangement order;

control elements disposed on each of the drive blocks for controlling the recording elements in the associated drive block in a simultaneous driving manner;

a selection means for selecting the drive block to be driven in order that at least adjacent drive blocks are not to be driven in sequence; and a supply means for supplying driving signals to the drive block selected by the selecting means.

Furthermore, in order to accomplish the above objects, the ink jet recording head according to the present invention for ejecting ink to record characters or other images on media to be recorded thereon, comprises:

a plurality of recording elements;

a plurality of drive circuits for selectively driving the recording elements; and a control means for drive controlling said drive circuits in the sequence based on the drive sequence setting data.

Moreover, in order to achieve the above objects, the ink jet recorder according to the present invention, comprises:

a plurality of ink passages disposed correspondingly to a plurality of ejection outlets for ejecting ink;

a plurality of energy generation means disposed correspondingly to the ink passages for generating energy which is used for the ink ejection;

a common ink chamber communicating with the ink passages; and a drive means for time-division driving said energy generation means by one block, said drive means driving the energy generation means associated with a non-ejection block after driving the energy generation means associated with the predetermined block so as to return in the substantially earliest time to the normal position the meniscus of the ejection outlet associated with the non-ejecting block adjacent to the predetermined block.

DETAILED DESCRIPTION OF THE PREFERRED EMBODIMENTS

Prior to the description of embodiments according to the present invention, it will be described in detail why mutual interferences between respective ink passages take place in the recording head having a structure in which a plurality of ink passages open into one common ink chamber.

Here, mutual interference means the effect that the amount and the speed of ink ejection by the second ink ejection in the case where Step 2 is carried out immediately after Step 1 differs from those in the case where Step 1 is absent or Step 2 is carried out after the elapse of a sufficiently long time after Step 1, in which, Step 1: Ink is ejected through the specified ejection outlet of the recording head by the first ink ejection;

Step 2: Ink is ejected through the ejection outlet adjacent to the ejection outlet of Step 1 by the second ink ejection.

Deterioration of the ejection characteristics means that the variations in the amount and the speed of ink ejection are so great as to bring about deterioration of the quality level of characters or images to be recorded thereon. It should be noted that the quality level greatly depends on the variation in the amount of ink ejection. In addition, the more the number of the ejection outlets which eject ink at the same time in Step 1 or 2, and the shorter the distance between the rear end of the partition wall of a plurality of ink passages and the rear surface of the common ink chamber of the recording head, the more prominently the interference is apt to occur.

Figure 18A:
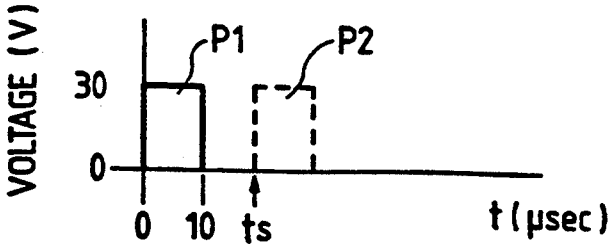
FIGS. 18A and 18B shows how the pressure is transmitted during applying pulse voltage to the electric/-thermal transducer of the recording head.

The reason why this mutual interference takes place will be described with reference to FIGS. 18A and 18B. FIG. 18A shows a timing t=0 when the first ejection in the foregoing Step 1 is carried out by activating heating resistors which form energy generators of the recording head through a pulse $P_1$, and a timing t=ts when the second ejection in the foregoing Step 2 is carried out through a pulse $P_2$. The pulse widths of $P_1$ and $P_2$ are 10 μsec, respectively, and the voltage to be applied to the heating resistors is 30 V.

Figure 18B:
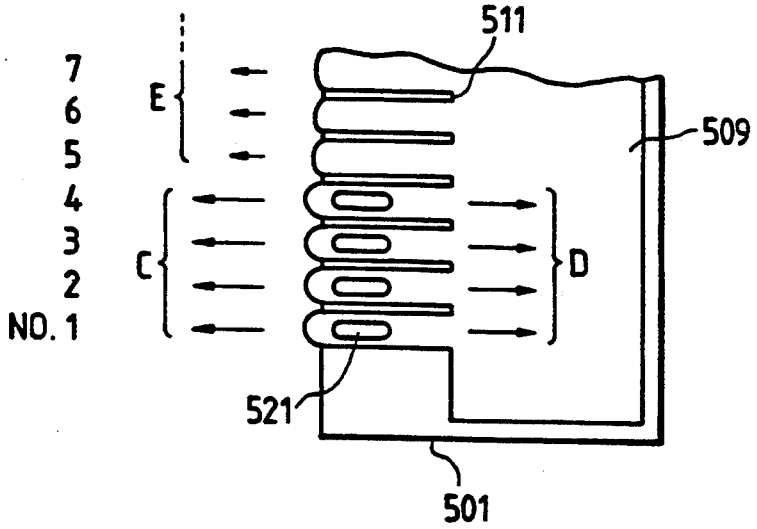

FIG. 18B is a partial sectional view illustrating one portion of the above-mentioned recording head 501, in which energy generators for the ink passage Nos. 1 to 4 are driven at the same time through the first pulse $P_1$, and energy generators for the ink passage No. 5 to 8 are ready to be driven through the second pulse $P_2$. Due to heat generation of the energy generators for the ink passages No. 1 to 4, bubbles 521 are produced and the ink commences to be ejected in the direction as shown by the arrow C. At the same time, a small quantity of ink flows back into the common ink chamber 509 as shown in the arrow D. This effect does not allow the ink to be thoroughly ejected through the ejection outlets which communicate with the ink passages Nos. 5 to 7 in the direction as shown in the arrow E. Nevertheless, the ink protrudes a little in the direction of the ejection, in other words, the meniscus which is the interface between the ink and outside air slightly becomes convex. Thereafter, the ink can be normally ejected through the ejection outlet which open into the ink passages No. 1 to 4.

However, if $P_2$ is applied at t=ts=13 (μsec) to eject the ink through the ejection outlet which open into the ink passages No. 5 to 8, the ink may be ejected from the convex surface of meniscus. As compared with the case in which $P_2$ is only applied without $P_1$, the volume of ink which is ejected through the ejection outlets opening into the ink passages No. 5 to 8 is increased by ΔV, that is, larger ink droplets are forced to be ejected.

In general, it is known that deterioration of the quality level of recording can be acknowledged by viewing when the variation in the amount of ink ejection at the adjacent recording points reaches approximately 10 (%).

It is difficult to measure correctly the increment of the amount of ink ejected through the ejection outlet opening into the ink passage No. 5. Nevertheless, the following result is anticipated through the approximate calculation. In the state of FIG. 18B, the amount of protrusion of meniscus from the ejection outlet which communicate with the ink passage No. 5 was 10 (μm). Though the section of the actual ink passage has the dimensions of 20 (μm)×25 (μm), we approximated the section to be a cylinder of 25 (μm) in diameter.

Figure 19:
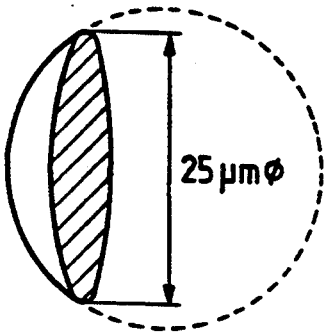
FIG. 19 shows the approximate model of the convex meniscus.

Based on the microscopic viewing, we approximated the protrusion of the meniscus to a portion of the sphere as shown in FIG. 19. In consequence, the increment resulting from the protrusion of meniscus is represented by the following formula:

$$\Delta V1=2.98 \text{ (pico liter)}$$

Next, in the normal condition where ink is not ejected, the meniscus is slightly concave by 2 (μm). The difference between this and the plane surface of the ejection outlet is:

$$\Delta V2=0.16 \text{ (pico liter)}$$

As a result, the increment in the amount of ink ejection is represented by the formula:

$$\begin{aligned}\Delta V &= \Delta V1 + \Delta V2 \\ &= 3.14 \text{ (pico liter)}\end{aligned}$$

As the ejection amount of a standard ink droplet is about V=28 (pico liter), the variation in ink droplets is:

$$\Delta V/V=11.2\%$$

This deteriorates the quality level of recording.

In the previous description, $P_2$ is applied at the timing of the ejection outlet opening into the ink passage No. 5 is protrusive to the last degree. It was seen that the variation in the amount of ink droplets becomes larger when $P_2$ is applied slightly earlier than this timing. This is attributed to the facts that there is a lag between the time when the voltage is applied to the energy generator and the time when bubbles is generated inside the ink, and that the force to which the ink is subjected in the direction of ejection is larger in the state where the meniscus is moving in the direction of protrusion than in the state where the meniscus is protrusive to the last degree.

In addition, when $P_2$ is applied in the vicinity of t=40 (μsec), the variation of ink droplets turned to negative. This phenomenon is attributed to the facts that the meniscus which has been once convexed is retrieved to the normal condition due to its surface tension, and the resultant kinetic energy forces the meniscus to be concaved from the normal condition, and that the arrows D and E in FIG. 18B face to the opposite directions at the timing when the bubbles which have been produced in the ink passages No. 1 to 4 disappear.

Figure 20:
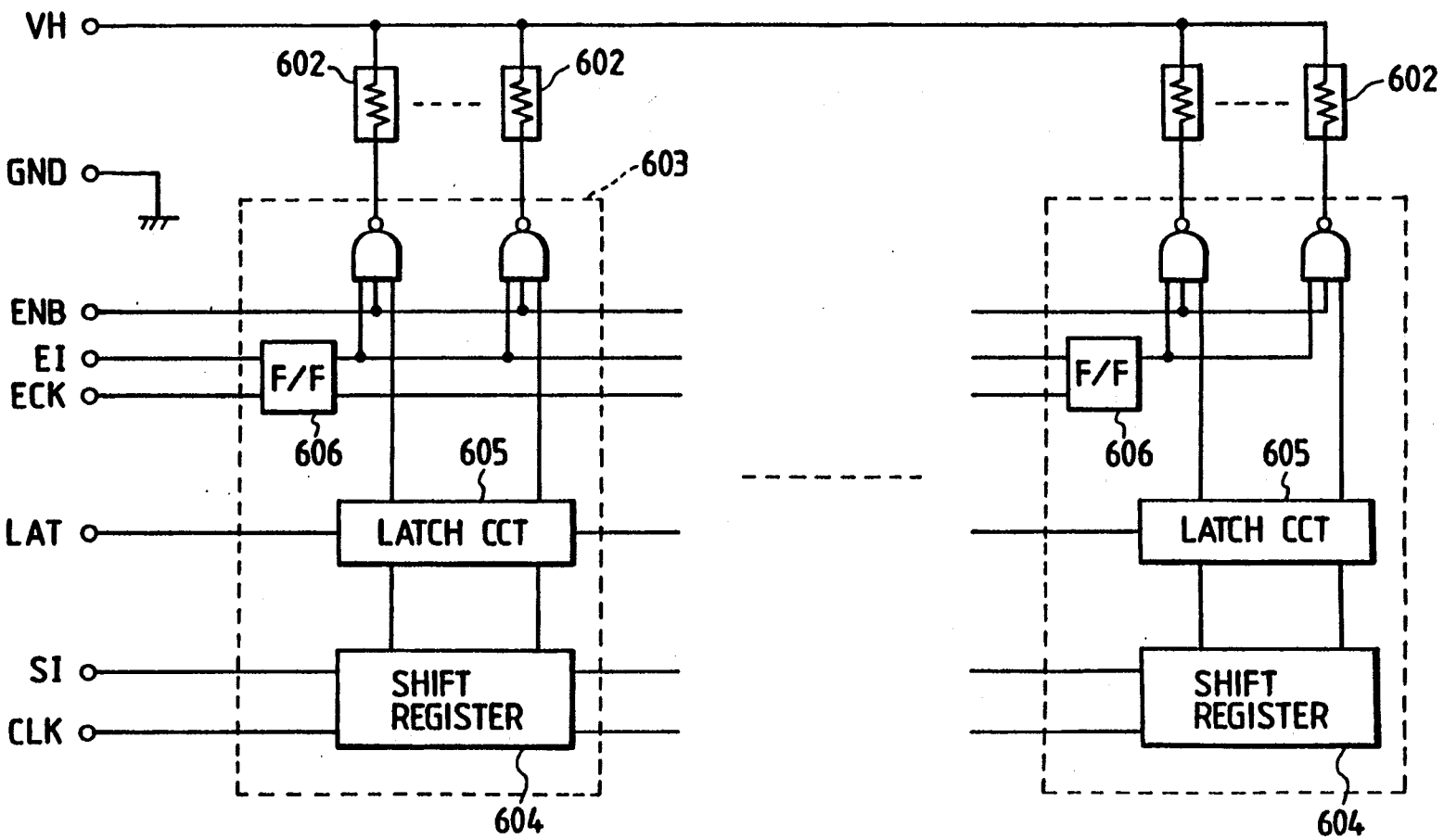
FIG. 20 PRIOR ART
FIG. 20 is a block diagram showing the circuit of the conventional ink jet recording head.
Figure 21:
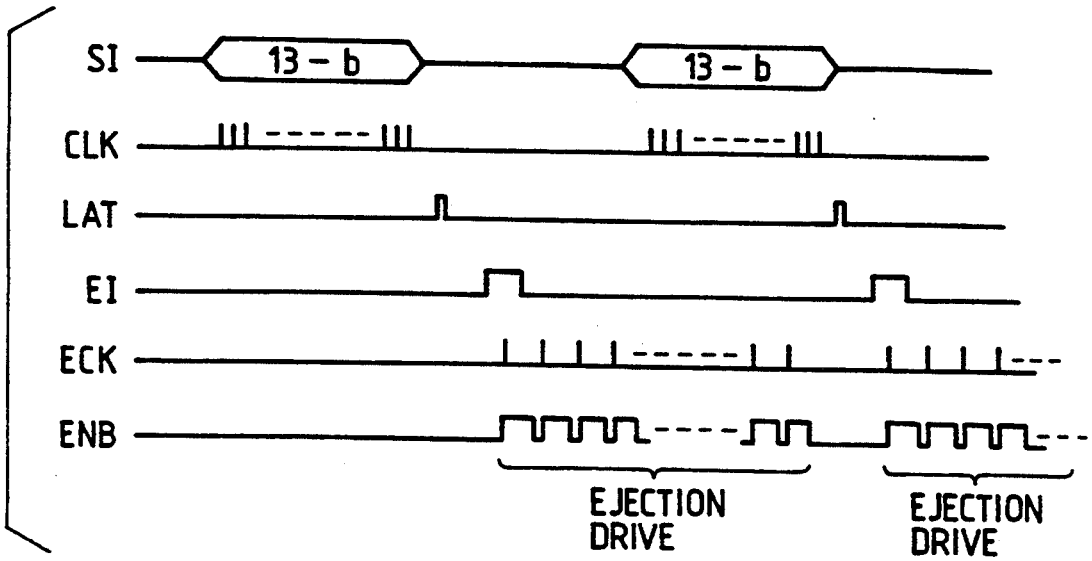
FIG. 21 PRIOR ART
FIG. 21 is a timing chart for generating the various signals by the conventional driving system.
Figure 22:
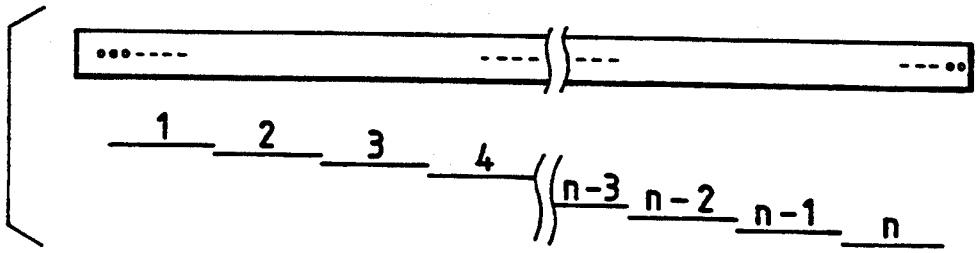
FIG. 22 PRIOR ART
FIG. 22 is an explanatory view showing the driving sequence for the drive blocks in compliance with the timing as shown in FIG. 21.

FIG. 20 shows, by way of example, the configuration of the driving apparatus for the conventional ink jet recording head. FIGS. 21 and 22 show the drive timing thereof. In FIG. 20, the reference numeral 602 denotes electric/thermal transducers which are disposed corresponding to a plurality of ink ejection outlets not shown. Recording data (SI; 13-b) having the same number of bits as that of the electric/thermal transducer are successively transferred to a shift register 604 inside a driving IC 603 in the synchronism with a data transfer clock (CLK) as shown in FIG. 21. After all the data have been input, the transferred recording data SI are read into a latch circuit 605 through the input of the latch signals (LAT). And then, the driving IC is sequentially activated through a flip-flop (F/F) 606 in compliance with the input of division driving signals (EI) and a division driving signal transfer clock. Thereafter, only when pulse width setting signals (ENB) are ON, electric/thermal transducer 602 having the driving IC 603 of which recording data signals are ON is selectively energized in the sequence as shown in FIG. 22, thereby ejecting ink through the ejection outlet 13.

Hereinafter, embodiments of the present invention will be described in detail and concretely with reference to the accompanying drawing.

Figure 1:
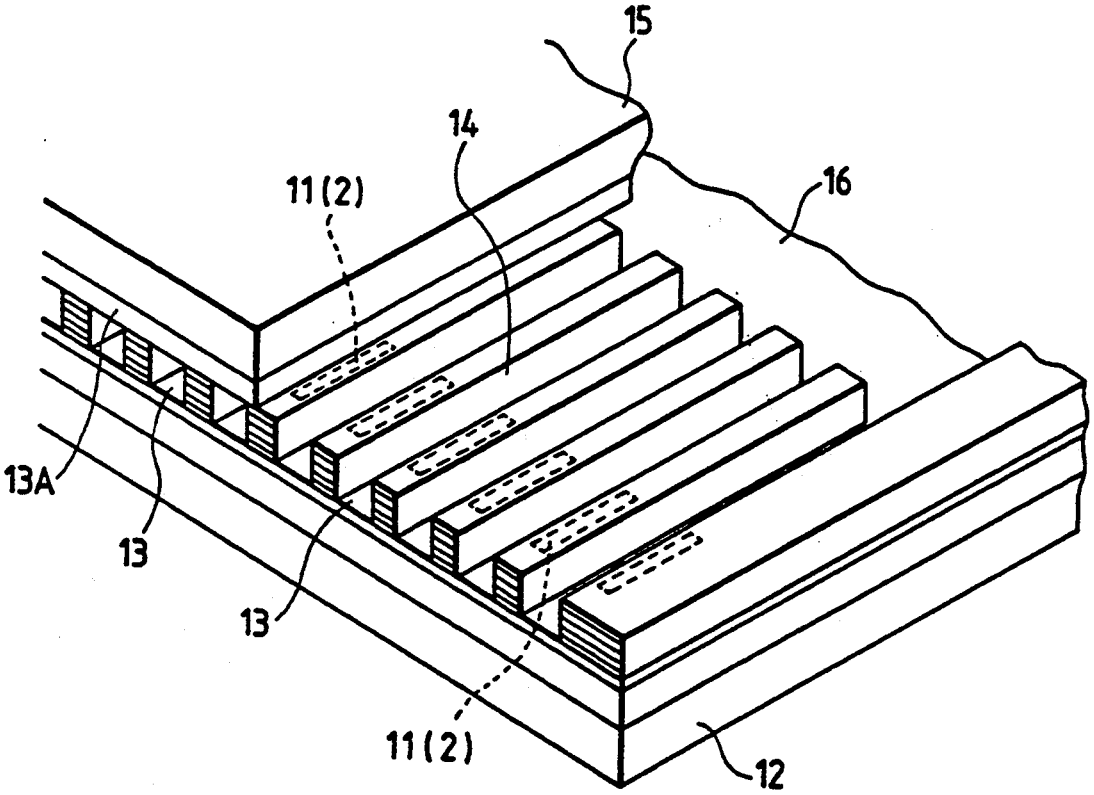
FIG. 1 PRIOR ART
FIG. 1 is a partially cut-away perspective view showing the configuration of the ink jet recording head embodying the present invention.

FIG. 1 shows an ink jet recording head to which this invention is applicable, specifically, a so-called full multiple type ink jet recording head in which ejection outlets are aligned across the range corresponding to the entire width of the member to be recorded thereon.

Here, the reference numeral 11 denotes a heating resistor constituting an electric/thermal transducer 2 which generates heat in correspondence with energizing to thereby produce bubbles inside ink due to the film boiling, thus forcing ink to be ejected. The heating resistors 11 are formed together with the wiring on a substrate 12 through the same manufacturing process as that for semiconductors. The reference numeral 13A denotes an ink passage formation member for forming ejection outlets 13 and ink passages 14 which communicate with the ejection outlets 13 correspondingly to the heating resistor 11, and 15 a top plate. The reference numeral 16 denotes a common ink chamber which opens into respective ink passages 14 and stores ink supplied from an ink supply source not shown.

Figure 2:
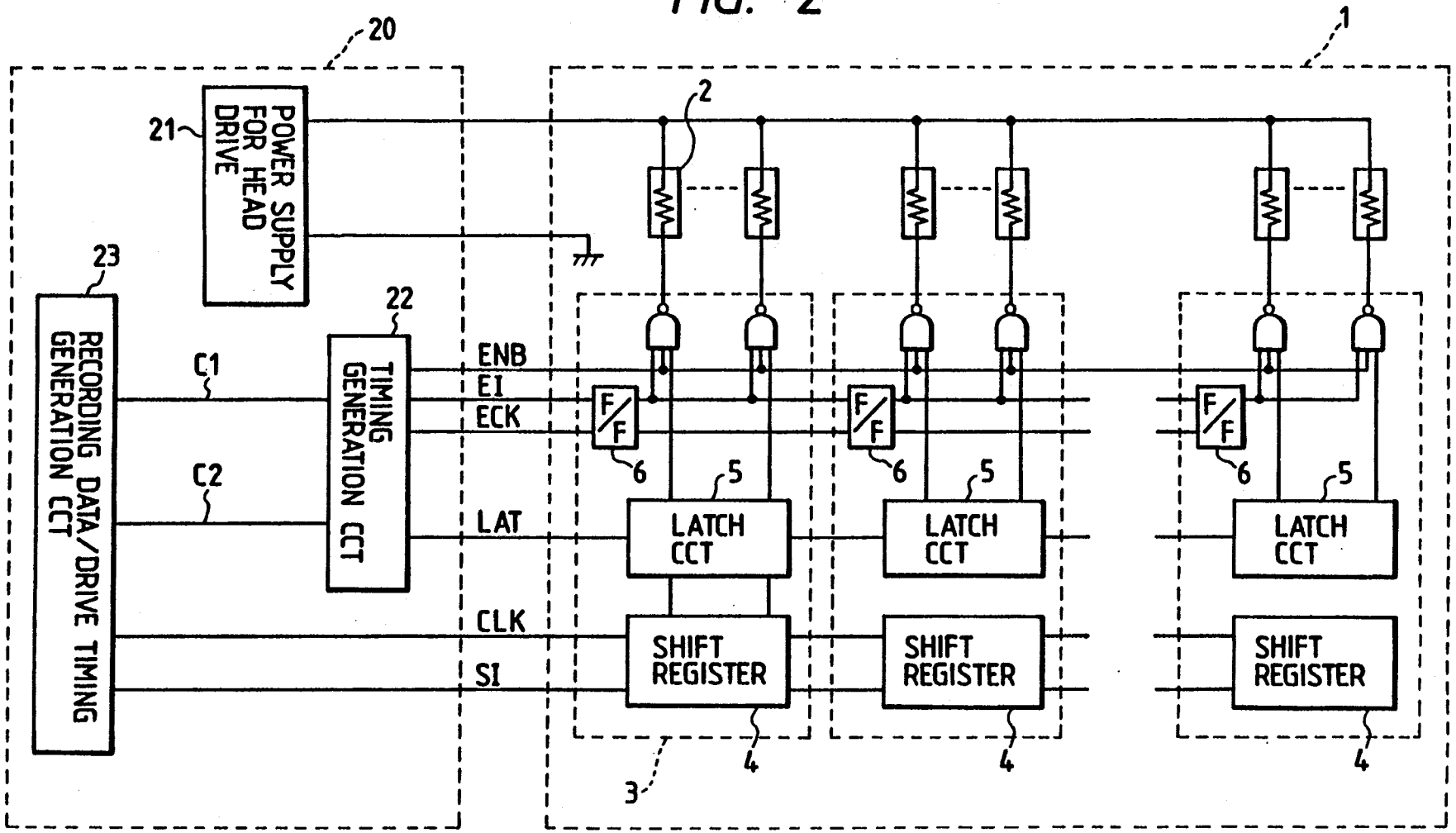
FIG. 2 is a block diagram illustrating a circuit for the recording head driving system according to the first embodiment of the present invention.
Figure 5:
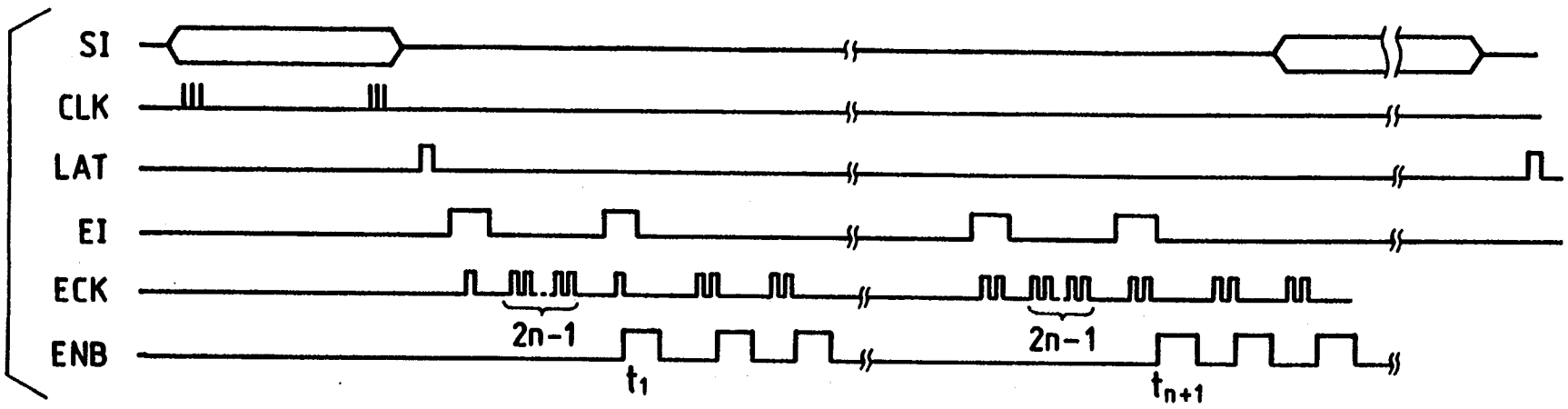
FIG. 5 shows an example of timing for generating various signals according to the second embodiment of the present invention.

FIG. 2 shows, by way of example, a drive control system for the ink jet recording head 1 having a mechanical structure as shown in FIG. 1 and an electrical structure in which a plurality of electric/thermal transducers can be driven by one block as shown in FIG. 5.

The reference numeral 20 denotes a head drive circuit according the present embodiment, which includes a gate circuit not shown, a power supply 21 for head drive, timing generation circuit 22, and a recording data/drive timing generation circuit 23.

In the head drive circuit 20 thus configured, the timing generation circuit 22 generates pulse width setting signals ENB, division driving signals EI, division driving signal transfer clocks ECK and latch signals LAT corresponding to control signals C1 and C2 sent from the recording data/drive timing generation circuit 22, to supply to respective drive IC's 3 of the recording head.

Figure 3:
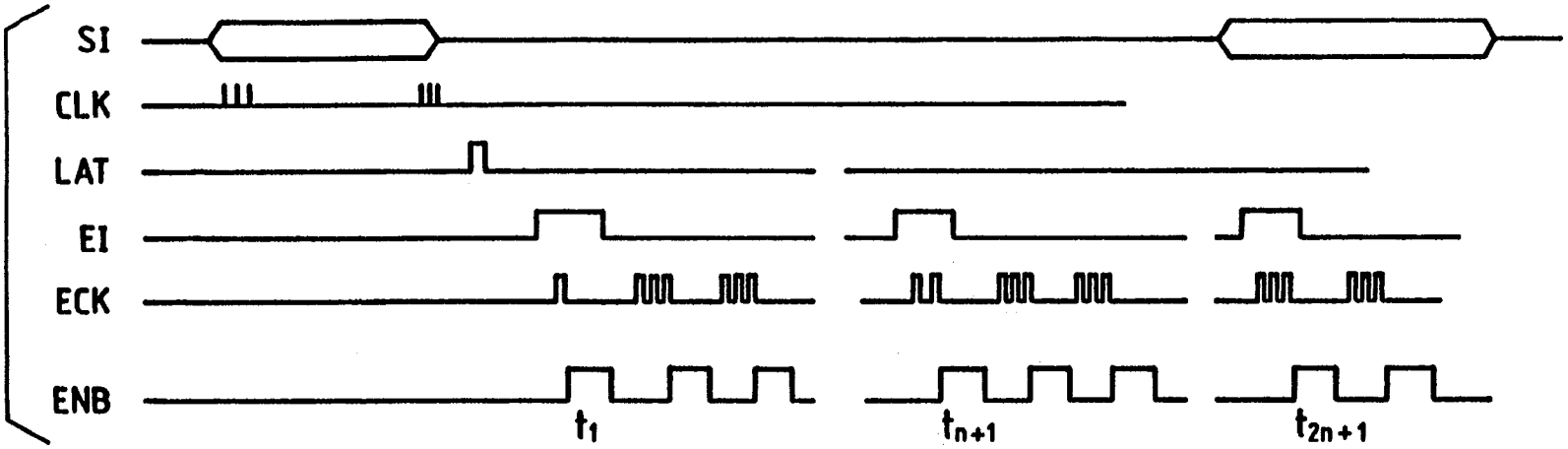
FIG. 3 is a timing chart for generating a variety of signals by the driving system circuit of the present invention.
Figure 4:
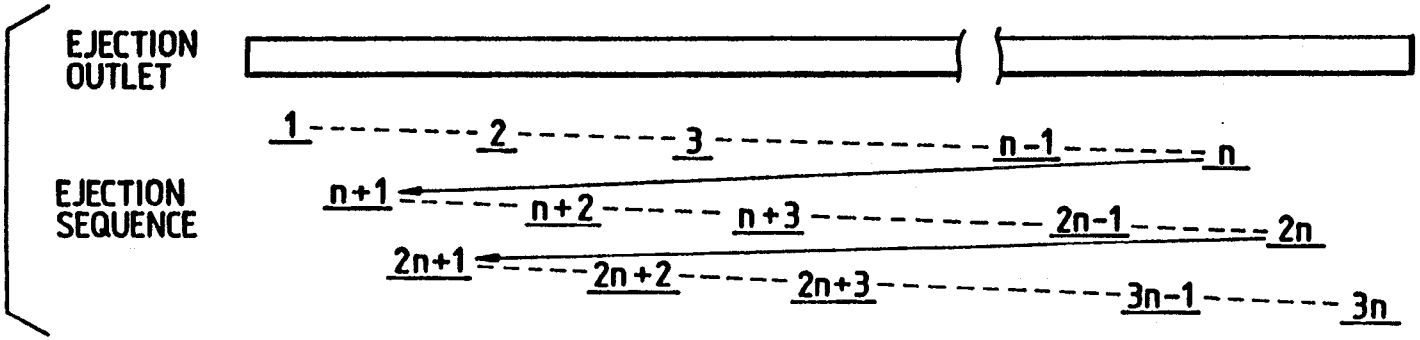
FIG. 4 is an explanatory view showing the driving sequence for the drive blocks in compliance with the timing as shown in FIG. 3.

FIG. 3 shows the drive timing according to the present embodiment. The recording data SI having the same number of bits as that of the electric/thermal transducer 2 are input in the synchronism with the recording data transfer clock CLK before they are read into the latch circuit 5 in the drive IC 3 through the latch signals LAT. And then, the division driving signals EI are shifted up to the block which can be energized means of the division driving signal transfer clock ECK, and the signals ENB are input to commence to energize by the block. In this case, the division driving signals EI and the division driving signal transfer clock ECK are input at the timing when adjacent blocks are not energized simultaneously as will be described later. At the timing in FIG. 3, the drive blocks are shifted by three blocks during the drive of respective blocks, so that every third block is energized as shown in FIG. 4. Furthermore, in the second and third period, the drive starts at the second and third block, respectively, so that the division driving signals EI are shifted by two and three blocks, respectively through the transfer clock ECK, respectively.

FIG. 4 shows an example of the energizing and the ejection sequence for the respective blocks composed of 1 to 3n according to the present embodiment. In case of a 4736 dot line head of which recording dot density is 16 dots/mm, when the number of electric/thermal transducers 2 which are connected to one drive IC 3 is 64, and that of electric/thermal transducers which are driven at the same time is 128, 37 blocks are sequentially ejected every third block to carry out the recording.

Figure 6:
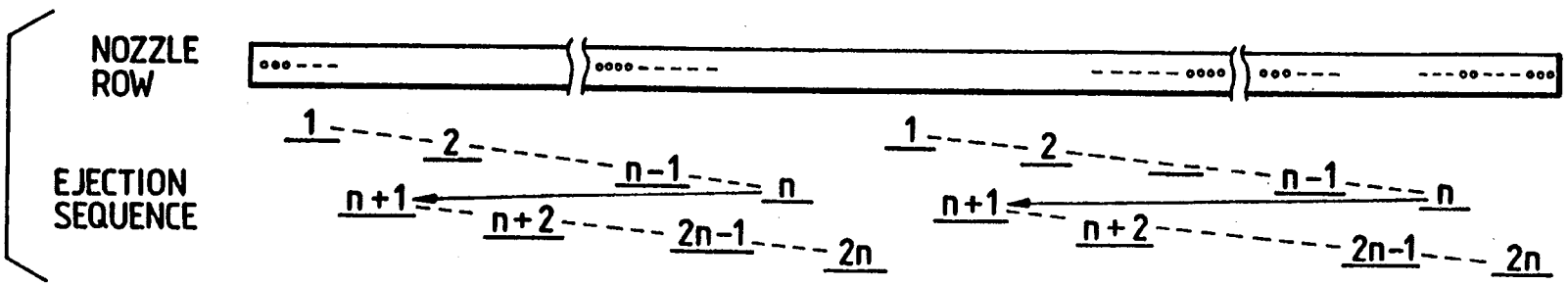
FIG. 6 is a explanatory view showing the driving sequence for the drive blocks in compliance with the timing as shown in FIG. 5.

FIGS. 5 and 6 show the timing and energizing/ejection sequence for respective blocks according to the second embodiment of the present invention. In this embodiment, the electric/thermal transducers are divided into 4n blocks to lessen the number of bits which are included in one block. Moreover, two signals EI which are 2n away from each other are input so that two blocks which are 2n blocks away from each other can be driven at the same time. Also, as the drive blocks are shifted by two blocks during driving the respective blocks, every second block is energized. Thus, the pressure of ink to be ejected is dispersed and the influence thereof can be lowered. In the first and second embodiment described above, every second or third block was sequentially energized. However, the interval of the blocks which is energized in sequence should suitably determined in accordance with the configuration and dimensions of the ink chamber, and the number of the bits. Subject to the interval of every second block or over, it would not be restricted to the specified range.

Figure 17:
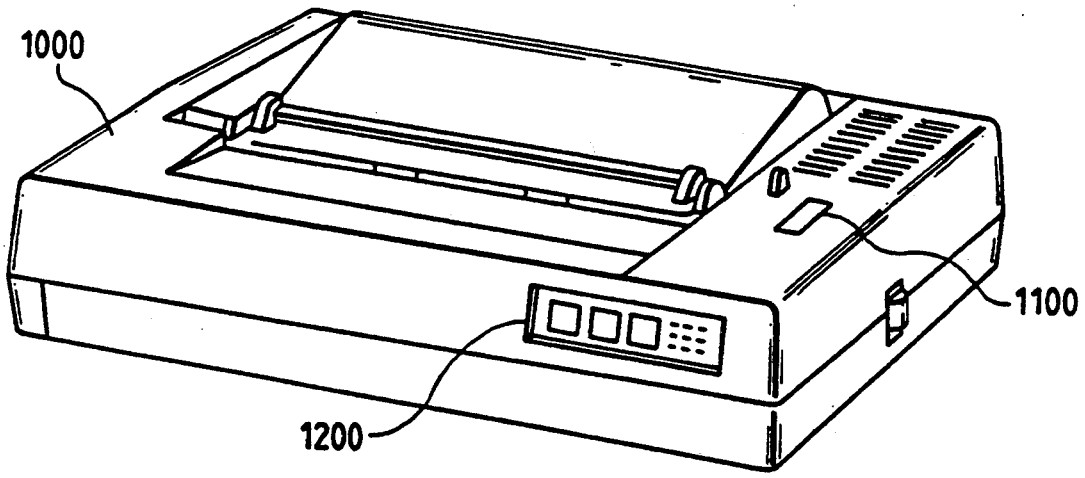
FIG. 17 PRIOR ART
FIG. 17 is a pictorial perspective view showing the appearance of one example of the ink jet apparatus according to the sixth embodiment.

The drive method for the recording head as described above can be used to constitute a line printer which is capable of full-color recording, for example, as shown in FIG. 17. The explanation of its structure will next be made with reference to FIG. 7.

The reference numerals 1A, 1B, 1C and 1D denote full-multiple type recording heads which are arranged in parallel. Through the ejection outlets of these recording heads 1A, 1B, 1C and 1D, color ink of cyan, magenta, yellow and black, respectively, are ejected at the predetermined timing toward the member 17 to be recorded thereon. The images are then recorded on the member 17 in compliance with the shift of the member 17 corresponding to the timing as described above. In the present embodiment, the member 17 is a continuous sheet which can be folded up. The reference numeral 18 denotes rollers for transferring sheet, 19 denotes rollers near the discharge section which holds the continuous sheet 17 in its recording position in cooperation with the sheet transfer roller 18 and transfers the sheet 17 in the direction of the arrow in connection with the sheet transfer roller 18 through the drive means not shown.

According to the first and second embodiments as described above, the adjacent blocks are not allowed to be driven sequentially, so that the fluctuation in the pressure of ink which would take place during the ejection of ink is not to be transmitted to the adjacent ink passage. As a result, the irregularity in depth of the recorded image which would occur due to the fluctuation in the ink pressure can be eliminated with a relatively simple means. It is thus possible to provide an ink jet recorder which is compact and capable of recording with high speed and high quality.

Figure 8:
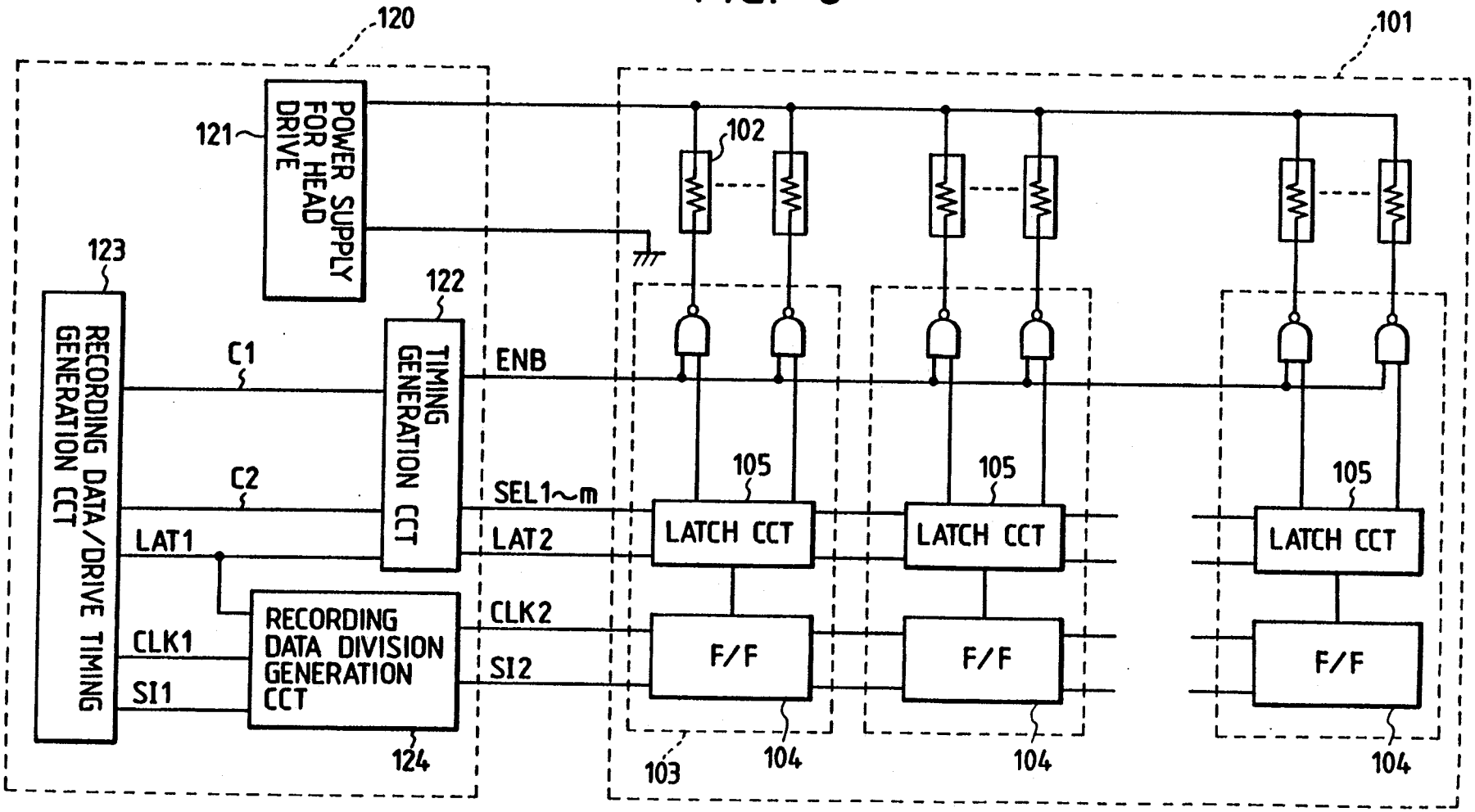
FIG. 8 is a block diagram showing the configuration of the circuit according to the third embodiment.

The third embodiment of the present invention will next be described with reference to the accompanying drawings 8 to 10. In FIG. 8, the identical parts to those in FIG. 2 are marked with the same reference numerals.

The reference numeral 120 denotes a head drive circuit according to the present embodiment, which includes a gate circuit not shown, a power supply 121 for head drive, a timing generation circuit 122, a recording data/drive timing generation circuit 123 and a recording data division generation circuit 124.

In the head drive circuit 120 thus configured, the timing generation circuit 122 generates pulse width setting signals ENB corresponding to control signals C1, C2 sent from the recording data/drive timing generation circuit 123. It also selects the latch position at the latch circuit 105 in which the recording data to be input is latched, to thereby generate selection signals SEL1 to SELm for selecting electric/thermal transducer 102 to be driven of respective blocks, and the latch signals LAT2. In the recording data division generation circuit 124, the recording data corresponding to the electric/thermal transducer 102 to be simultaneously driven are sampled and reconfigured among the recording data SI1 for one line, thereby supplying them to the recording head drive IC 103 in the form of a signal SI2 and a clock signal CLK 2, respectively.

Figure 9:
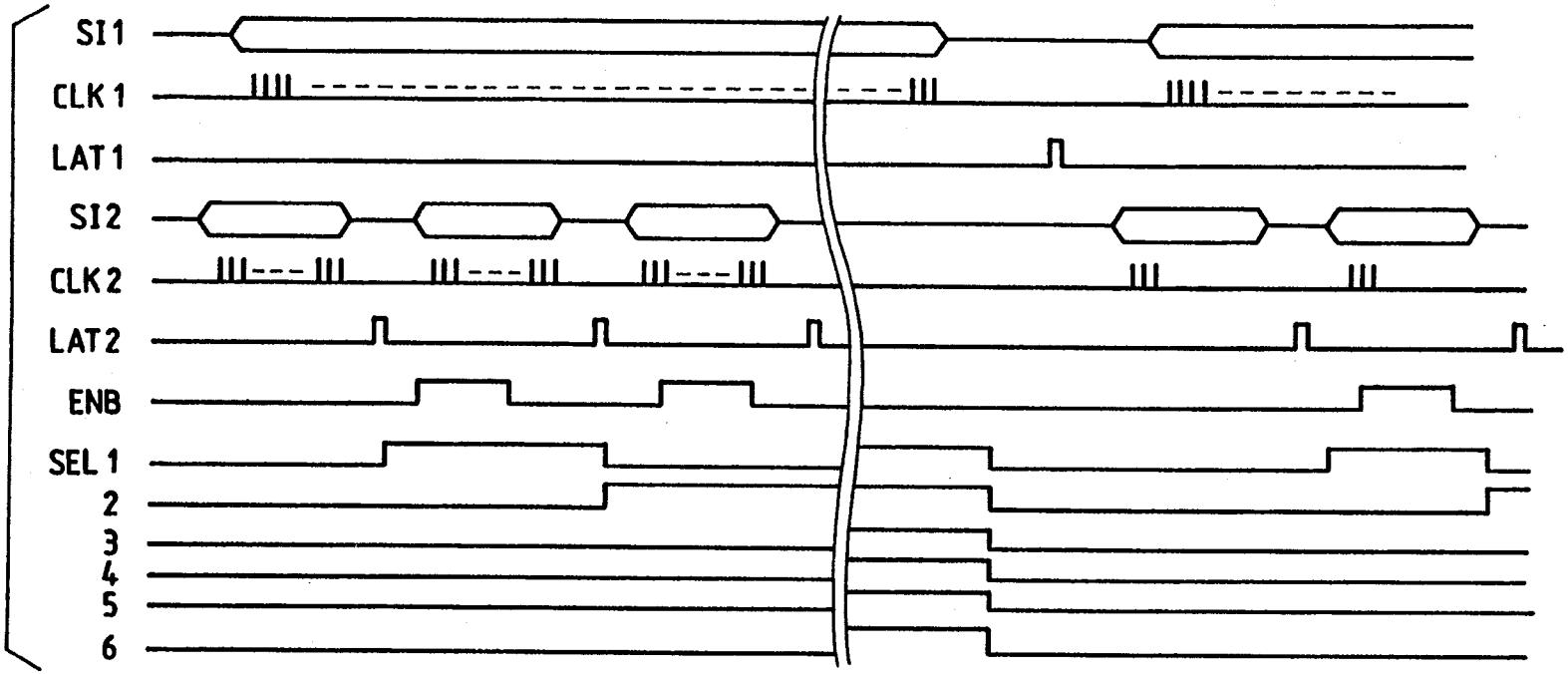
FIG. 9 is a timing chart for the generation of various signals by the driving system circuit according to the third embodiment.

FIG. 9 shows the drive timing of the present embodiment. The recording data SI1 for one line having the same number of bits as that of the electric/thermal transducer 102 are divided and reconfigured into the recording data SI2 corresponding to the electric/thermal transducers 102 which are simultaneously driven in the recording data division generation circuit 124, and then transmitted to the foregoing recording head 101. The data SI2 are then read into the respective latch circuits 105 in the drive IC 103 which are selected by the selection signals SEL1 to SELm through the input of latch signal LAT 2. The electric/thermal transducers 102 which have been selected corresponding to the input of the pulse width setting signal ENB are thus energized. In this way, above-mentioned data transfer and the input of selection signals SEL1 to SELm and the pulse width setting signals ENB are repeated predetermined times which is equal to the number of elements constituting respective blocks, thereby performing the record for one line.

Figure 10:
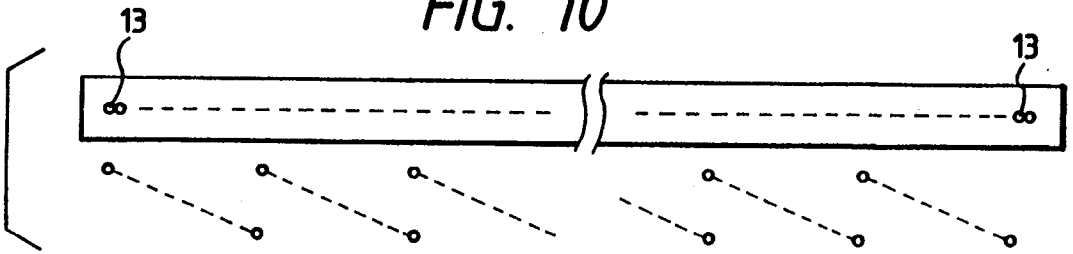
FIG. 10 is an explanatory view showing the driving sequence for the drive blocks in compliance with the timing as shown in FIG. 9.

FIG. 10 shows the driving sequence for the electric/-thermal transducer not shown in the row of ejection outlets 13 according to the present embodiment. In the respective drive IC's 103 as can be seen from this drawing, though the electric/thermal transducers 102 which have been selected through the timing generation circuit 122 are driven at the same time, the positions of the ejection outlets are suitably arranged away from each other. Consequently, the subsequent ink ejection is not to be influenced.

In the above example, the number of the recording data which is transferred to the recording head 101 was equal to the number of bits to be driven simultaneously, thereby selecting electric/thermal transducers 102 to be driven through the selection signals SEL1 to SELm. However, as long as the data transfer time lies within the permissive range, it is also possible to thus drive in the conventional circuit as shown in FIG. 20 previously. In this case, the recording data corresponding to the electric/thermal transducers 2 which are not driven at the same time should be fixed to the non-energizing side, and to the respective drive IC 603 should repeat the transfer of data having the same number of bits as the number of the all electric/thermal transducers 602, thus enabling like driving.

Figure 7:
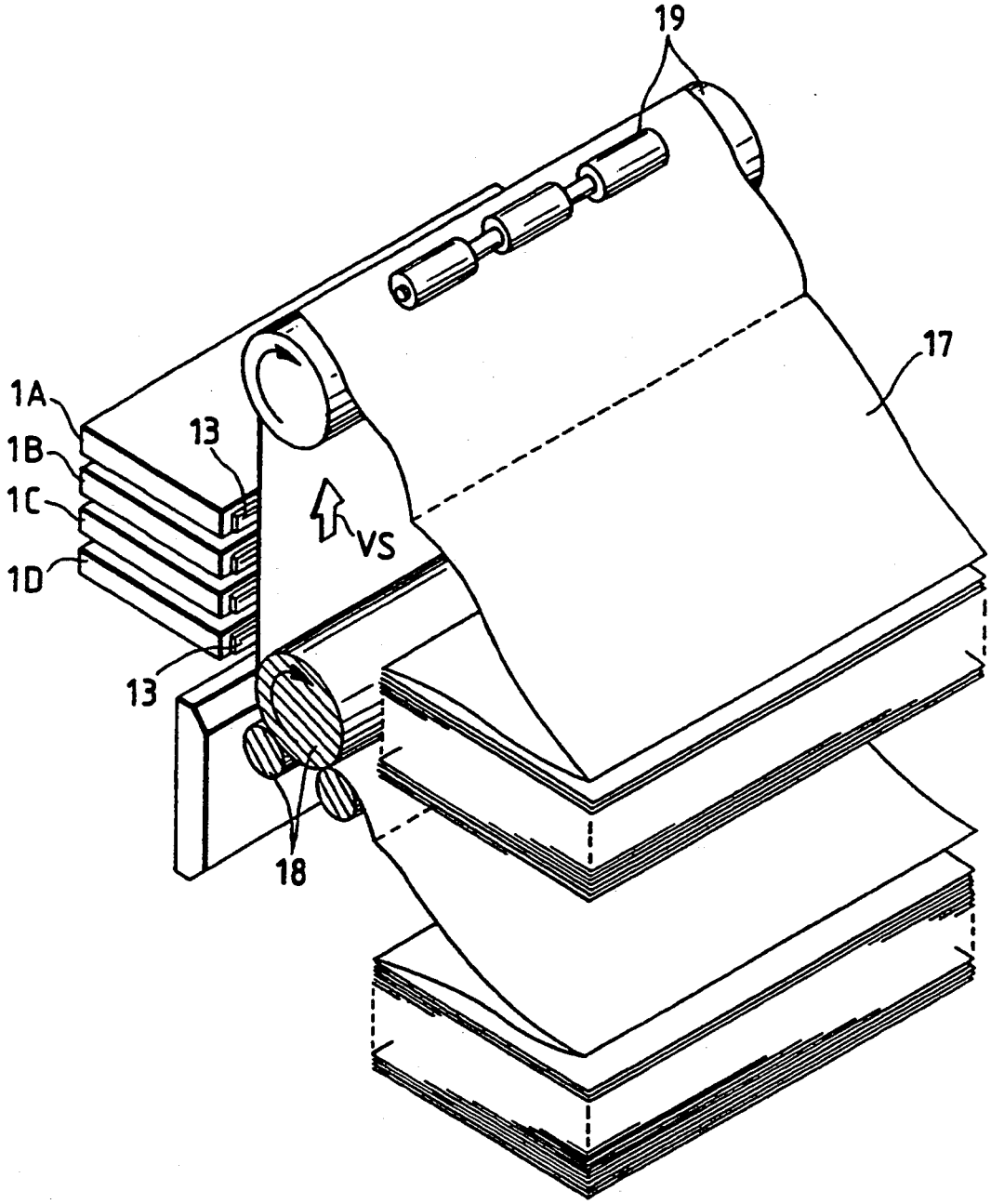
FIG. 7 PRIOR ART
FIG. 7 is a pictorial perspective view of the line printer employing the head driving method according to the present invention.

Similar to the embodiments previously shown, according to the above drive method, a line printer capable of full-color recording as shown in FIG. 7 can be constituted.

According to the third embodiment of the present invention, among a plurality of electric/thermal transducers, the electric/thermal transducers of specified intervals are sequentially selected to be simultaneously driven so that the adjacent electric/thermal transducers are not to be driven at one time, thus scattering the electric/thermal transducers to be driven at one time. Due to this, the fluctuation in the ink pressure which is caused during the ejection of ink does not affect further ejection of ink, which would otherwise cause the irregularity in depth of the recorded images. Recorded images of high quality can be thus ensured.

Figure 11:
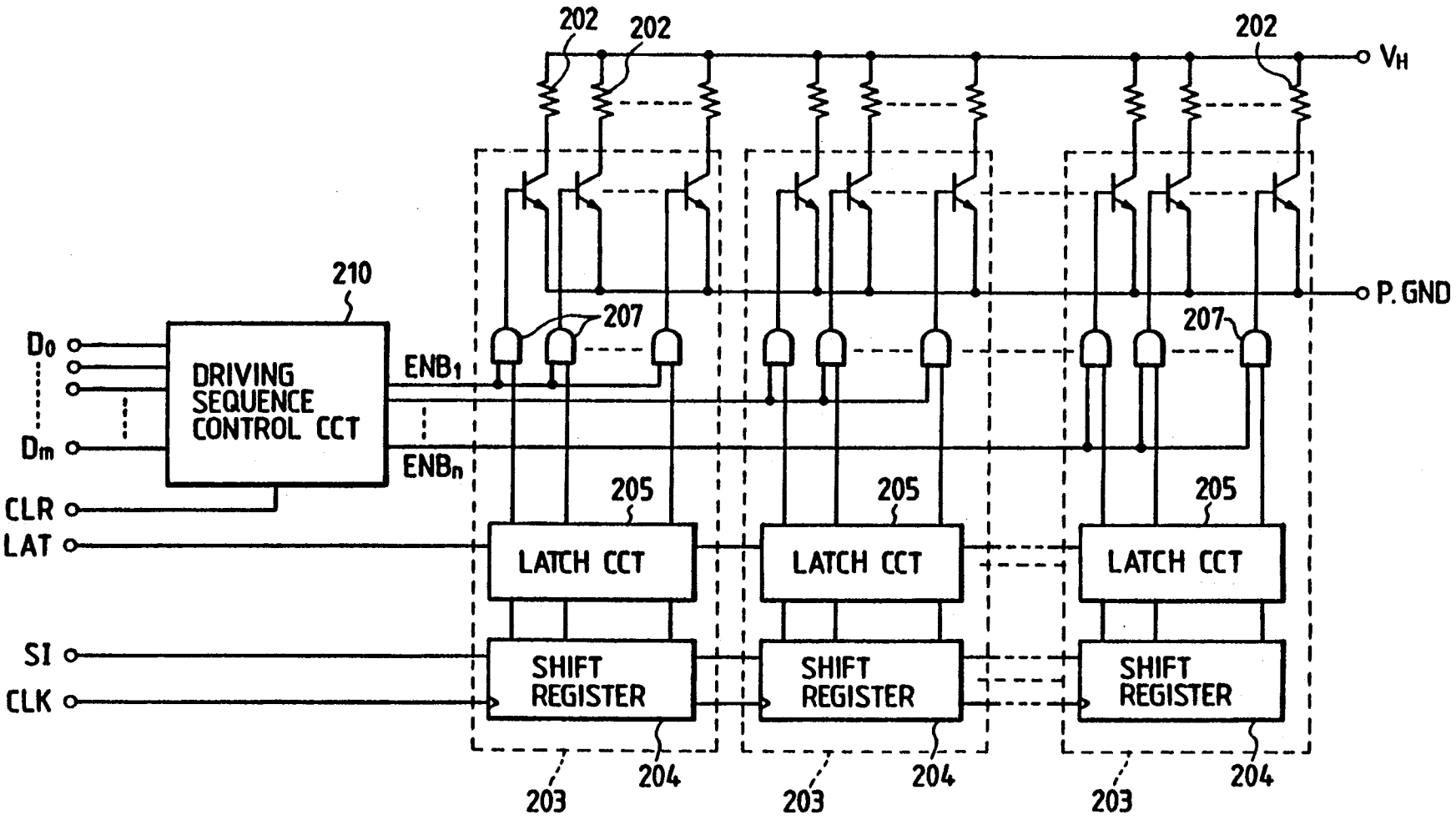
FIG. 11 is a block diagram showing the drive control system for the ink jet recording head according to the fourth embodiment of the present invention.
Figure 12:
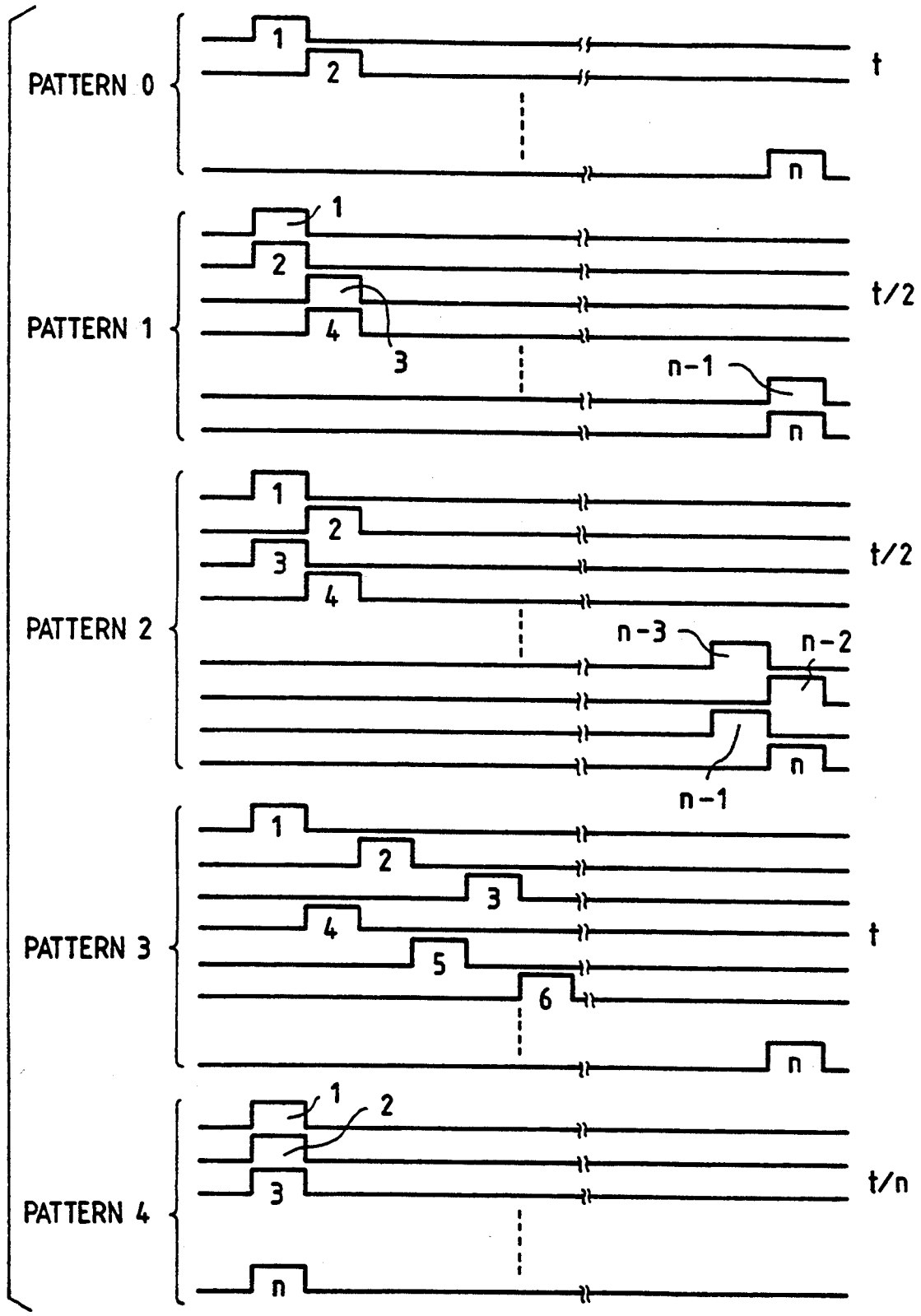
FIG. 12 is a pattern view showing the timing of the driving sequence according to the fourth embodiment.

The fourth embodiment of the present embodiment will next be described with reference to FIGS. 11 and 12. In FIG. 11, the correspondent parts to those of FIG. 2 are marked with the correspondent reference numerals.

In FIG. 11, SI denotes a recording data input terminal, CLK denotes a transfer clock input terminal for transferring the recording data which are input into SI. The reference numeral 204 denotes 64-bit shift registers which are correspondent to heating elements 202, respectively. The recording data for one line are forwarded to the shift registers 204 through SI and CLK, and then loaded into the 64-bit latch circuits 205 in compliance with the latch input which is input into the LAT input terminals. A driving sequence control circuit 210 selects the heating elements 202 in accordance with the recording data as will be described later.

In FIG. 11, there is provided strobe terminal on each drive IC 203 which is composed of a 64-bit shift register 204, a 64-bit latch circuit 205. Strobe signals ENB1 to ENBn which are input through the foregoing circuit 210, and the output of the 64-bit latch circuit 205 corresponding to the respective heating elements 202 are both input into AND circuits 207 which allow the heating elements 202 to be driven through the corresponding drive transistors. The division driving of the heating elements 202 can be thus accomplished.

With respect to the division driving, the driving sequence control circuit 210 determines the driving sequence based on m-bit pattern data which is input into the driving sequence setting data input terminals $D_o$ to $D_m$, and activates the strobe terminal which is provided on respective sequence drive IC's. FIG. 12 shows an example of the driving sequence pattern in accordance with signals which are output into the strobe terminal (The numerals represent the packaging sequence for drive IC's).

Patterns 0 and 1 show the normal division drive timing at which 64-bit and 128-bit heating elements are simultaneously driven, respectively.

Patterns 2 and 3 show examples of driving sequence timing according to the present embodiment, which are provided to improve the recording quality level. It should be noted that the adjacent drive IC's are not allowed to be driven sequentially in pattern 3. As a result, the recording quality level can be improved. In this pattern, every second drive IC is driven. Instead, each drive IC may be driven with an interval of several IC's. When the degree of irregularity in depth slightly varies with the ink jet recording head to be used, any pattern can be selected in accordance with the desired printing quality level.

In this way, the driving sequence control circuit having a plurality of patterns is so provided as to optionally set the optimum pattern in accordance with the desired printing quality level.

Figure 13:
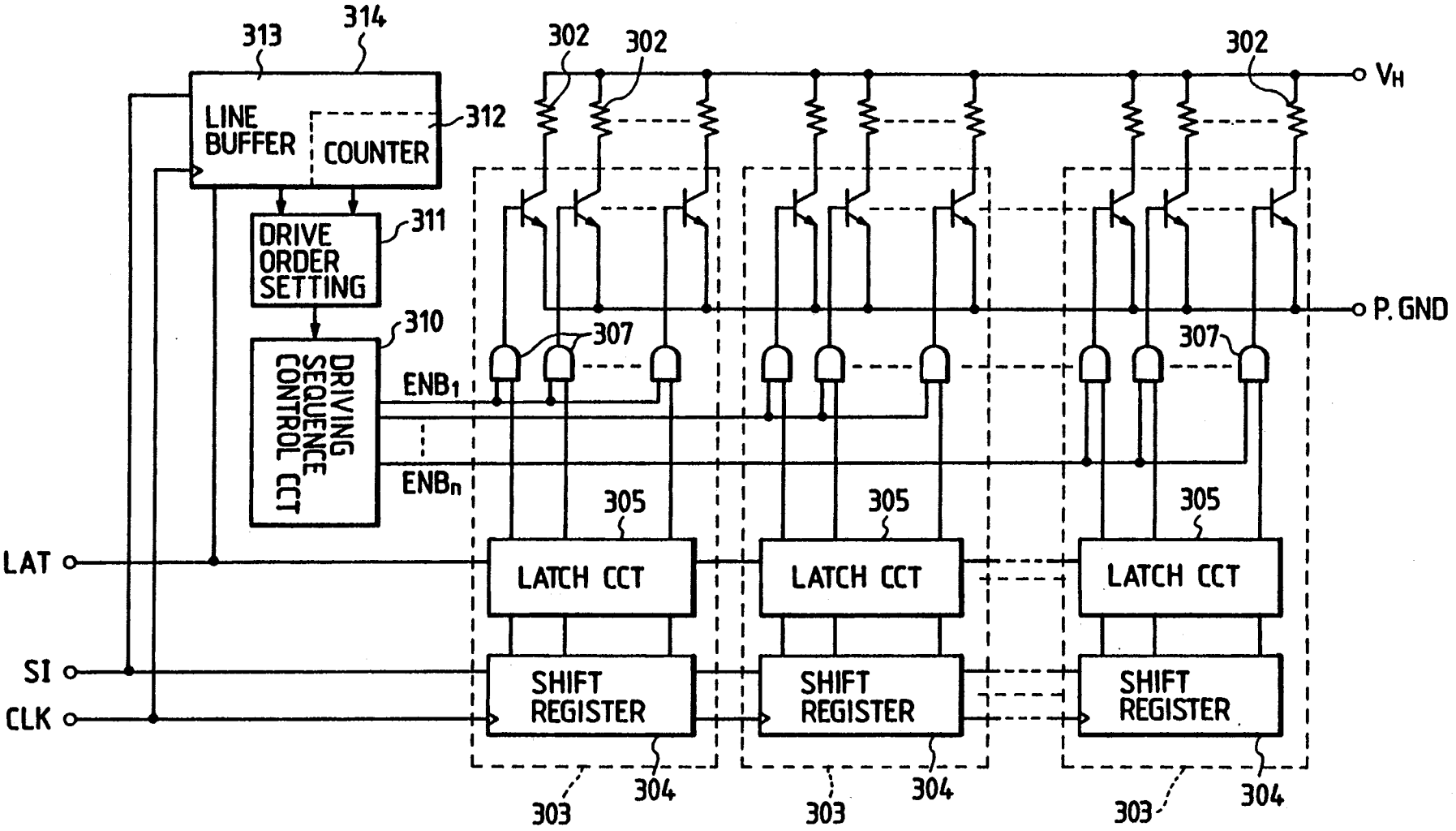
FIG. 13 is a block diagram showing the drive control system for the ink jet recording head according to the fifth embodiment.

Next, the fifth embodiment of the present invention is illustrated in FIG. 13.

In order to provide the fifth embodiment as shown in FIG. 13, from the embodiment shown in FIG. 11 there are added a line buffer 313 which stores the recording data for one line, a counter 312, and a driving sequence set circuit 311 which supplies control data to the foregoing driving sequence control circuit 310 through the output thereof. Due to this constitution, the recording data can be retrieved by one line, and optimum driving sequence can be established in case of recording.

A recording data input terminal SI and a data transfer clock CLK are connected to a 64-bit shift register 304 as well as the line buffer 313 and the counter 312 which counts the order of the recording information in the recording data for one line. A recording information retrieval unit 314 composed of the line buffer 313 and the counter 312 retrieves the recording information in accordance with these input. The output of the recording information retrieval unit 314 is supplied to the driving sequence set circuit 311 where drive sequence pattern data which is optimum for the recording information can be obtained. These pattern data are input into the driving sequence control circuit 310. In this way, when the drive for one line is determined, the recording is commenced (the action is similar to FIG. 11) through the input into the LAT terminal, and at the same time the line buffer 313 and the counter 312 are cleared to input the recording data for the next line.

The above-mentioned control makes it possible to change the drive method every one line. For example, when the line includes the recording data which are liable to cause the irregularity in depth, an appropriate drive sequence pattern may be selected so as to eliminate it, or when the line includes less recording information, a simultaneous driving pattern may be employed. As a result, while the quality level of the recording can be improved, the recording speed can be shortened for the line having less recording information.

The ink jet recording head and its control system as described above can be also used to constitute the line printer capable of full-color recording as shown in FIG. 7. According to the fourth embodiment of the present invention, the drive sequence pattern can be optionally selected, thereby eliminating the irregularity in depth and improving the quality of the recording without a more complicated drive IC.

Also, as seen in the fifth embodiment, the recording information can be retrieved every one line to thereby change the drive pattern and perform a high speed recording.

Similar effects can be achieved in the serial printer head of which ink jet recording head has a plurality of drive IC's to be mounted thereon. In addition, similar effects can be obtained with respect to the drive IC's which have complicated drive circuits capable of controlling the pulse width of every heating element.

The sixth embodiment of the present invention will next be described in detail.

Figure 14:
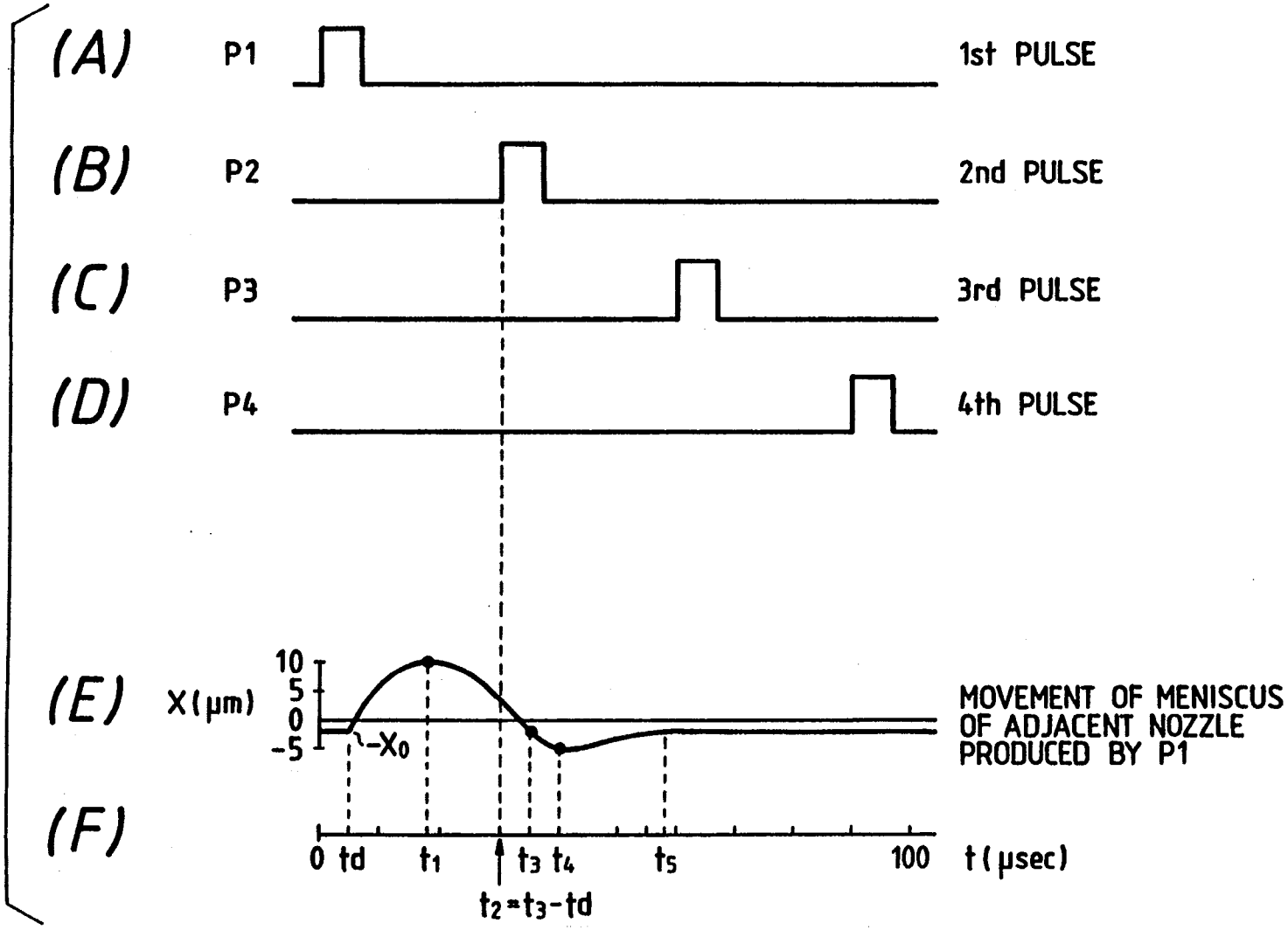
FIG. 14 is a timing chart for the drive of the ink jet recorder according to the sixth embodiment of the present invention.

FIG. 14 shows the drive timing for the ink jet recorder according to the sixth embodiment of the present invention. The fundamental structure of the recording head is substantially the same as the structure of the recording head shown in FIG. 18. The total of ejection outlets is 4637, the interval of the ejection outlets are 63.5 (μm), and the recording can be done across the width of approximately 30 cm at the recording density of 400 DPI. The distance d from the rear portion (the communicating portion between the ink passage and the common ink chamber) of the ink passage partition wall 511 to the rear edge wall of the common ink chamber 509 is 2 (mm), which is smaller than that in prior art.

In FIG. 14, (A) denotes the first pulse $P_1$ which drives at one time energy generators of ink passages No. 1 to 64, (B) denotes the second pulse $P_2$ which drives at one time energy generators of ink passages No. 65 to 128, (C) denotes the third pulse $P_3$ which drives at one time energy generators of ink passages No. 129 to 192, and (D) denotes the fourth pulse $P_4$ which drives energy generators of ink passages No. 193 to 256. Hereinafter, it reaches the 74th pulse in the same manner to drive energy generators of all the ink passages. Any pulse width is 7 (μsec).

Chart (E) denotes the amount of protrusion X (μm) of the meniscus at the ejection outlet communicating with the ink passage adjacent when pulse $P_1$ is only applied to the energy generators of ink passages No. 1 to 64, in other words, ink passage No. 65. Here, the sign + means convexity, and the sign − means concavity. In the normal condition, $X=-2$ (μm). The movement of the meniscus of the ejection outlet communicating with the ink passage No. 66 is gentler than that of the meniscus of the ejection outlet communicating with the ink passage No. 65.

Chart (F) represents the time-axis t (μsec) for (A) to (D).

Referring now to (E), after application of the pulse $P_1$ and after the elapse of time delay $t_d$, that is, at $t=t_d$, $X_d$ commences to increase from its normal condition $X=X_0$ and reaches its maximum at $t=t_1$. Afterward, X returns to its normal condition $X=-2$ at $t=t_3$, and then goes down to its minimum at $t=t_4$. Subsequently, at $t=t_5$, X again returns to its normal condition $X=-2$, thereafter the amount X of the protrusion of the meniscus remains unchanged.

Here, the amount of ink ejection caused by $P_2$ when $P_2$ is applied in the vicinity of $t=t_1$ after applying $P_1$, becomes greater than the amount of ejection caused by only $P_2$ without $P_1$. On the other hand, the amount of ink ejection caused by $P_2$ when $P_2$ is applied at $t=t_4$ after applying $P_1$, grows smaller than the amount of ejection caused by only $P_2$ without $P_1$.

It has come clear that the amount of ink ejection caused by $P_2$ when $P_2$ is applied at $t_2=t_3-t_d$ (μsec) after applying $P_1$ remains unchanged despite of the presence or absence of $P_1$. In other words, mutual interference is not observed.

In this case, the energy generators of all the ink passages are subjected to the division drive. When the energy generators of the ink passages No. 1 to 64 which constitute the first block are driven by the pulse $P_1$ to eject the first block, the meniscus of the ejection outlets communicating with the ink passages No. 65 to 128 which constitutes the second block adjacent to the first block turns convex. Subsequently, the energy generators of the second block are substantially driven at the time $t=t_3$ when the meniscus of the ejection outlets of the second block returns closest to the same position as that in the normal condition. Since the energy acts on ink with the time delay of $t_d$ (μsec) after applying pulse $P_1$, $P_2$ was applied at $t_2=t_3-t_d$. As to the following $P_3$, $P_4$, . . ., $P_{74}$, $t_3=2\times t_2$, $t_4=3\times t_2$, . . . were used.

Figure 15:
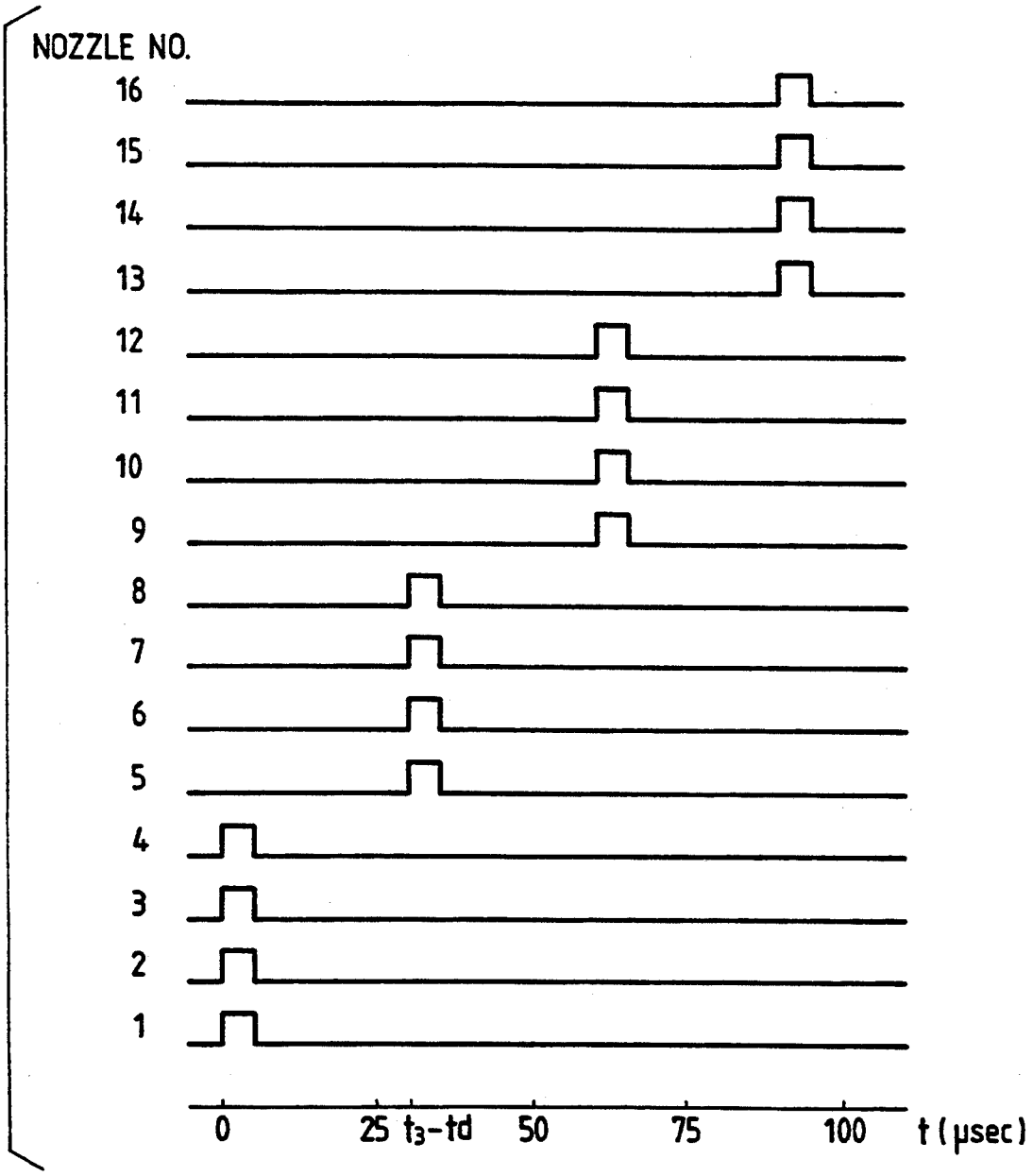
FIG. 15 is a timing chart showing the division driving method according to the sixth embodiment.

FIG. 15 shows the timing of division driving. The interval of applying pulse was $t_s-t_d$ in the prior art. In the present embodiment, however, it is $t_3-t_d$, thus making it possible to double the recording speed.

Additionally, $t_3$ is the time when $X=X_0$, however, satisfactory effects can be obtained within the range of $X=X_0\pm1$ (μm). To be concrete, $t_d=5$ (μsec), $t_3=35$ (μsec), and $t_2=30$ (μsec). However, $t_2$ may be 29 (μsec) to 31 (μsec).

Figure 16:
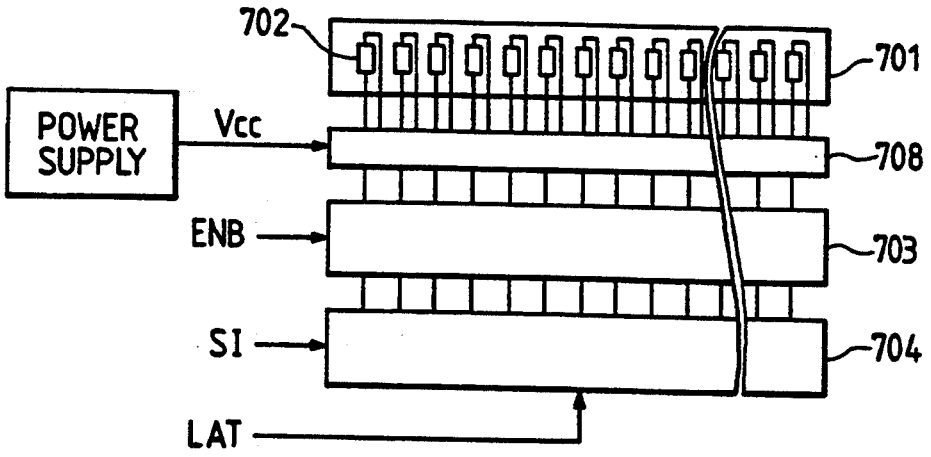
FIG. 16 PRIOR ART
FIG. 16 is a schematic block diagram showing the driving circuit for the recording head according to the sixth embodiment.

FIG. 16 is a block diagram schematically showing the drive circuit for the recording head. Firstly, recording data SI of 4736 pieces in serial order which are correspondent to all the ink passages, are forwarded to a data latch circuit 704 where the recording data are temporarily memorized by means of latch signals LAT. When the digital recording data are on H level, the recording is carried out, that is to say, ink is allowed to be ejected. In the same manner, the recording data are on L level, no recording is implemented. These recording data are then forwarded to a logic circuit 703. When recording start signals ENB are input into the logic circuit 703, enabling signals (P1, P2, P3, . . .) are produced for each block as shown in FIG. 14. The enabling signals and the latched recording data are ANDed to selectively drive transistors 708 of 4736 pieces likewise. When the transistors 708 turn on, the heating elements 702 of corresponding ink passages generate heat, thereby ejecting ink.

In the above-mentioned embodiments, all the ink passages of Nt=4736 were division driven by Nb=64. However, without being restricted to these numbers, the present invention is applicable to all the cases in which Nt is 2 or more, Nb is 1 or more, and all the ink passages are division driven. It should be preferably noted that the more Nb, the more resultant effects, because the more Nb, the more mutual interference between the adjacent ink passages. In particular, the resultant effects are noticeable when Nb is 64 or over.

The above embodiments use electric/thermal transducers as energy generators, but may use other energy generators, for instance, electric/mechanical transducers such as piezoelectric elements. The present invention is also applicable to the cases in which the ink ejection is performed by static electricity or electric discharge as long as the meniscus of the adjacent ink passages are displaced.

FIG. 17 is a pictorial perspective view showing the appearance of one example of the ink jet apparatus according to the present embodiments. In FIG. 17, the reference numeral 1000 denotes a body of the apparatus, 1100 a power supply switch, and 1200 an operation panel.

In the sixth embodiment of the present invention as described above, the recording head has a property that at the time of ejection of the specified block B1, the position of the meniscus of the adjacent block B2 which has not yet been ejected moves forward and backward in the direction of ejecting. The block B2 is substantially driven at the timing when the position of the meniscus returns earliest to the same position as that in the normal condition, thus ejecting ink without any mutual interference between the ink passages by one block, to consequently ensure the high quality level of recording.

In particular, greater the number of the ink passages Nd which are driven at one time, the more effective the present invention is. With Nd of 64 or over, the effects are minimized.

Moreover, the smaller the width d of the common ink chamber, more the mutual interference takes place, so that the effects to be accomplished by the present invention are large. Specifically, it is very effective when d is 6.0 (mm) or below.

Due to this, it is possible to provide a compact and low price of recorder.

The present invention brings about excellent effect particularly in a recording head and recording device of an ink system utilizing thermal energy among the ink jet recording system.

As to its representative constitution and principle, for example, one practiced by use of the basic principles disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made according to the constitution disclosed in Japanese Patent Laid-Open Application No. 59-123670 which discloses the constitution using a slit common to a plurality of electricity-heat convertors as the discharging portion of the electricity-heat converter or Japanese Patent Laid-Open Application No. 59-138461 which discloses the constitution having the opening for absorbing pressure waves of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or other heating elements or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

In addition, the ink jet recorder of the present invention may be used as a copying machine in combination with a reader or other devices, a facsimile system having a transmit/receive function, as well as an image output terminal unit for data processors such as computers.

What is claimed is:

1. A recording method comprising the steps of:

providing an ink jet recording head including a plurality of ink passages disposed correspondingly to a plurality of ejection outlets for ejecting ink, a plurality of energy generators which generate energy for ejecting ink, a common chamber for communicating with said ink passages and drive elements which drive and control said energy generators in accordance with recording data to be input and control signals;

dividing recording data into intervals of a predetermined number;

transferring the divided recording data in the sequence to said drive elements of said recording head; and driving at the same time said energy generators in intervals of the predetermined number to eject ink.

2. A recording method according to claim 1, wherein said energy generators comprise thermal energy generators which generate thermal energy used to eject ink.

3. A recording method according to claim 2, wherein said thermal energy generators bring about a variation in the state of ink due to heat, to thereby eject ink through said ejection outlets.

4. A recording method according to claim 3, wherein said variation in the state is film boiling, and bubbles formed by said film boiling eject ink through said ejection outlets.

5. A recording method according to claim 1, wherein said recording head comprises a full-multiple recording head having recording elements spanning a width corresponding to a width of a recording medium.

6. An ink jet recording head for ejecting ink to record characters or other images on media to be recorded thereon, said head comprising:

a plurality of ink passages disposed correspondingly to a plurality of ejection outlets for ejecting ink;

a plurality of recording elements;

a common chamber for communicating with said ink passages;

a plurality of drive circuits for selectively driving said recording elements;

means for receiving drive sequence setting data; and control means for drive controlling said drive circuits in the sequence based on the drive sequence setting data.

7. An ink jet recording head according to claim 6, wherein the drive sequence setting data is variable in accordance with recording characteristics of said recording head.

8. An ink jet recording head according to claim 6, wherein said control means includes a line buffer which stores recording data for one line and a counter which counts recording information, thereby making the drive sequence setting data variable in compliance with said line buffer and said counter.

9. An ink jet recording head according to claim 6, wherein said recording elements comprise thermal energy generators which generate thermal energy used to eject ink.

10. An ink jet recording head according to claim 9, wherein said thermal energy generators bring about a variation in the state of ink due to heat, to thereby eject ink through said ejection outlets.

11. An ink jet recording head according to claim 10, wherein said variation in the state is film boiling, and bubbles formed by said film boiling eject ink through said ejection outlets.

12. An ink jet recording head according to claim 6, wherein said recording head comprises a full-multiple recording head in which said recording elements span a width corresponding to a width of a recording medium.

13. An ink jet recorder, comprising:

a plurality of ink passages disposed correspondingly to a plurality of ejection outlets for ejecting ink;

a plurality of energy generation means disposed correspondingly to said ink passages for generating energy which is used for the ink ejection;

a common chamber for communicating with said ink passages; and drive means for time-division driving said energy generation means by block, said drive means driving the energy generation means associated with a non-ejection block adjacent a predetermined ejection block after driving the energy generation means associated with the predetermined block at the timing when the meniscus of ink in the ejection outlets associated with the non-ejection block returns earliest to a normal position.

14. An ink jet recorder according to claim 13, wherein the distance from the communicating opening between said plurality of ink passages and said common ink chamber to the rear edge surface of said common ink chamber is 6.0 mm or less.

15. An ink jet recorder according to claim 13, wherein the number of the energy generators which are driven by said division drive substantially at the same time is 64 or more.

16. An ink jet recorder according to claim 13, wherein the substantial timing when said energy generators associated with said non-ejection block are driven lies within 1 $\mu$sec on the basis of the return time.

17. An ink jet recorder according to claim 13, wherein said energy generators comprise electric/thermal transducers which generate thermal energy.

* * * * *

UNITED STATES PATENT AND TRADEMARK OFFICE

CERTIFICATE OF CORRECTION

PATENT NO. : 5,357,268 Page 1 of 3

DATED : October 18, 1994

INVENTOR(S) : Hideaki KISHIDA, et al.

It is certified that error appears in the above-indentified patent and that said Letters Patent is hereby corrected as shown below:

COLUMN 2:

Line 57, "being well as" should read --well as being--.

COLUMN 4:

Line 26, "shows" should read --show--.

COLUMN 5:

Line 17, "No. 5 to 8" should read --Nos. 5 to 8--;

Line 20, "No. 1 to 4," should read --Nos. 1 to 4,--;

Line 33, "No. 1 to 4." should read --Nos. 1 to 4.--;

Line 36, "No. 5 to 8," should read --Nos. 5 to 8,--;

Line 40, "No. 5 to 8" should read --Nos. 5 to 8--;

Line 53, "communicate" should read --communicates--.

UNITED STATES PATENT AND TRADEMARK OFFICE

CERTIFICATE OF CORRECTION

PATENT NO. : 5,357,268

DATED : October 18, 1994

INVENTOR(S) : Hideaki KISHIDA, et al.

It is certified that error appears in the above-indentified patent and that said Letters Patent is hereby corrected as shown below:

COLUMN 6:

Line 24, "is" should read --are--;
Line 39, "No. 1 to 4" should read --Nos. 1 to 4--;
Line 46, "outlets not" should read --outlets, not--.

COLUMN 8:

Line 14, "should" should read --should be--;
Line 36, "holds" should read --hold--;
Line 38, "transfers" should read --transfer--.

COLUMN 9:

Line 49, "transducers 2" should read --transducers 602--.

COLUMN 10:

Line 3, "embodiment" (second occurrence) should read --embodiments--;
Line 22, "204," should read --204, and--.

COLUMN 11:

Line 65, "No." should read --Nos.--;
Line 67, "No. 65" should read --Nos. 65--.

UNITED STATES PATENT AND TRADEMARK OFFICE

CERTIFICATE OF CORRECTION

PATENT NO. : 5,357,268 Page 3 of 3

DATED : October 18, 1994

INVENTOR(S) : Hideaki KISHIDA, et al.

It is certified that error appears in the above-indentified patent and that said Letters Patent is hereby corrected as shown below:

COLUMN 12:

Line 1, "No. 129 to 192," should read --Nos. 129 to 192,--;
Line 3, "No. 193 to 256." should read --Nos. 193 to 256.--;
Line 10, "No. 1" should read --Nos. 1--;
Line 43, "No. 1 to 64" should read --Nos. 1 to 64--;
Line 46, "No. 65 to 128" should read --Nos. 65 to 128--.

Signed and Sealed this

Second Day of May, 1995

Bruce Lehman

*Attest:*

BRUCE LEHMAN

*Attesting Officer*

*Commissioner of Patents and Trademarks*